US008331600B2

(12) United States Patent
Suzuki

(10) Patent No.: US 8,331,600 B2
(45) Date of Patent: Dec. 11, 2012

(54) NARROW DIRECTIONAL MICROPHONE

(75) Inventor: Shingo Suzuki, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 357 days.

(21) Appl. No.: 12/731,187

(22) Filed: Mar. 25, 2010

(65) Prior Publication Data

US 2010/0260369 A1 Oct. 14, 2010

(30) Foreign Application Priority Data

Apr. 9, 2009 (JP) ..... 2009-094724

(51) Int. Cl.
*H04R 9/08* (2006.01)

(52) U.S. Cl. ..... 381/360

(58) Field of Classification Search ..... 381/360
See application file for complete search history.

(56) References Cited

U.S. PATENT DOCUMENTS

| | | | | |
|---|---|---|---|---|
| 3,876,843 | A * | 4/1975 | Moen | 381/313 |
| 4,363,937 | A * | 12/1982 | Bruna | 381/360 |
| 7,415,121 | B2 * | 8/2008 | Mogelin et al. | 381/174 |
| 7,783,069 | B1 * | 8/2010 | Miller et al. | 381/354 |
| 8,175,313 | B2 * | 5/2012 | Piel et al. | 381/360 |
| 2004/0125975 | A1 * | 7/2004 | Suzuki et al. | 381/369 |
| 2006/0093167 | A1 * | 5/2006 | Mogelin et al. | 381/176 |
| 2007/0211911 | A1 * | 9/2007 | Sie | 381/122 |
| 2010/0142742 | A1 * | 6/2010 | Tanaka et al. | 381/346 |
| 2011/0150260 | A1 * | 6/2011 | Miles | 381/360 |

FOREIGN PATENT DOCUMENTS

| | | |
|---|---|---|
| JP | 62-118697 | 5/1987 |

* cited by examiner

*Primary Examiner* — Forrest M Phillips
(74) *Attorney, Agent, or Firm* — Whitham Curtis Christofferson & Cook, PC

(57) ABSTRACT

A narrow directional microphone includes: a microphone unit; an acoustic tube having an opening on a peripheral wall along an axial direction and incorporating the microphone unit; and, an acoustic resistor that covers the opening of the acoustic tube. The acoustic tube is overlapped with an air-shutoff sheet having a plurality of openings which have various lengths in the axial direction of the acoustic tube. The openings of the air-shutoff sheet overlap the opening of the acoustic tube so that a size of the opening of the acoustic tube is limited.

20 Claims, 9 Drawing Sheets

RELATED ART

RELATED ART

NARROW DIRECTIONAL MICROPHONE

BACKGROUND OF THE INVENTION

1. Field of the Invention

The present invention relates to a narrow directional microphone including an acoustic tube incorporating a microphone unit. More specifically, the present invention relates to a harrow directional microphone that allows adjustment to a desired narrow directivity with low cost and without cumbersome processes.

2. Description of the Related Art

Narrow directional microphones are known that include an elongated acoustic tube. In such narrow directional microphones, a microphone unit is provided in an inner space of one end of an acoustic tube, and an acoustic wave entering the acoustic tube from an opening at a front end, that is, the other end of the acoustic tube, is detected and converted into an acoustic signal by the microphone unit. For example, narrow directional microphone that is an acoustic tube is known in which: the acoustic tube is made of metal; an opening, e.g., a slit, arranged along the center axis is formed on a peripheral wall of the acoustic tube; and the opening is covered with an acoustic resistor such as a thin synthetic resin film or a nonwoven fabric attached on the peripheral wall of the acoustic tube. A narrow directional microphone having such a structure assures narrow directivity by making acoustic waves enter the acoustic tube from the front opening interfere with an acoustic wave entering the acoustic tube through the opening on the peripheral wail via the acoustic resistor.

An example of a conventional narrow directional microphone using an acoustic tube is schematically described below. In FIGS. 8 and 9, a narrow directional microphone 19 includes: an acoustic tube 12; an acoustic resistor 14; a microphone unit 18; and a grip 17. The acoustic tube 12 is an elongated cylinder made of metal and the like and has a plurality of slit 13 on a peripheral wall thereof. The slits 13 collinearly run along the center axis of the acoustic tube 12. The length of the slits 13 in the direction of the center axis becomes shorter in a stepwise manner as the slit 13 get closer to a portion at which the microphone unit 18 is provided. Therefore, acoustic resistance of each of the slits 13 becomes higher as the slits 13 get closer to the portion at which the microphone unit 18 is provided. Thus, narrow directional microphone which has the flat and excellent frequency characteristic can be obtained. If the lower and the upper end of the acoustic tube 14 as shown in FIG. 8 are the front and the rear end of the acoustic tube 14, the microphone unit 18 is provided in the inner space at the rear end. On an outer peripheral wall of the acoustic tube 12, the acoustic resistor 14 covering the slits 13 is attached. The acoustic tube 12 has both ends in the longitudinal direction opened. A front opening of the acoustic tube 12 guides in an acoustic wave from the front. The cylindrical grip 17 is integrally and continuously connected to the acoustic tube 12 at the rear end thereof.

Japanese Patent Application Publication No. S62-118697 discloses an invention related to a narrow directional microphone. In the narrow directional microphone according to the invention disclosed in Japanese Patent Application Publication No. S62-118697, an acoustic tube has openings provided on a plurality of portions in a circumferential direction thereof; and a plurality openings providing acoustic resistance and arranged in an axial direction with intervals therebetween. The acoustic tube also has a diaphragm attached on an interference pipe and covers the openings. By covering the openings with the diaphragm, an acoustic wave guided into the acoustic tube from the front is made to interfere with an acoustic wave with the phase largely varied. Therefore, acoustic waves other than that from a sound source at the front of the acoustic tube are largely attenuated. Thus, extremely narrow directivity can be obtained.

Unfortunately, trial production or processing of an opening of such acoustic tube requires certain man-hour costs. In other words, cumbersome processes have to be carried out on an acoustic tube made of metal each time to obtain appropriate narrow directivity. In addition, because processing of the acoustic tube requires high accuracy, the yield rate is degraded and the manufacturing cost becomes high.

SUMMARY OF THE INVENTION

In view of the above, an object of the present invention is to provide a narrow directional microphone using an acoustic tube requiring no cumbersome processes such as changing the size of an opening on the acoustic tube, and allows an easy adjustment of narrow directivity by changing an air-shutoff sheet to one having an opening of different size.

A narrow directional microphone according to an aspect of the present invention includes: a microphone unit; an acoustic tube having an opening on a peripheral wall along an axial direction and incorporating the microphone unit; and an acoustic resistor that covers the opening of the acoustic tube. The acoustic tube is overlapped with an air-shutoff sheet having a plurality of openings which have various lengths in the axial direction of the acoustic tube. The openings of the air-shutoff sheet overlap the opening of the acoustic tube so that the size of the opening of the acoustic tube is limited.

EFFECT OF THE INVENTION

With the present invention, in the narrow directional microphone, then narrow directivity can be adjusted only by changing the air-shutoff sheet to one having an opening of different size. Thus, a narrow directional microphone can be provided with which appropriate narrow directivity can be obtained with less man-hour costs on the acoustic tube to reduce manufacturing steps, which leads to an improvement of a yield rate and cost reduction.

DETAILED DESCRIPTION OF THE PREFERRED EMBODIMENTS

Figure 1A:
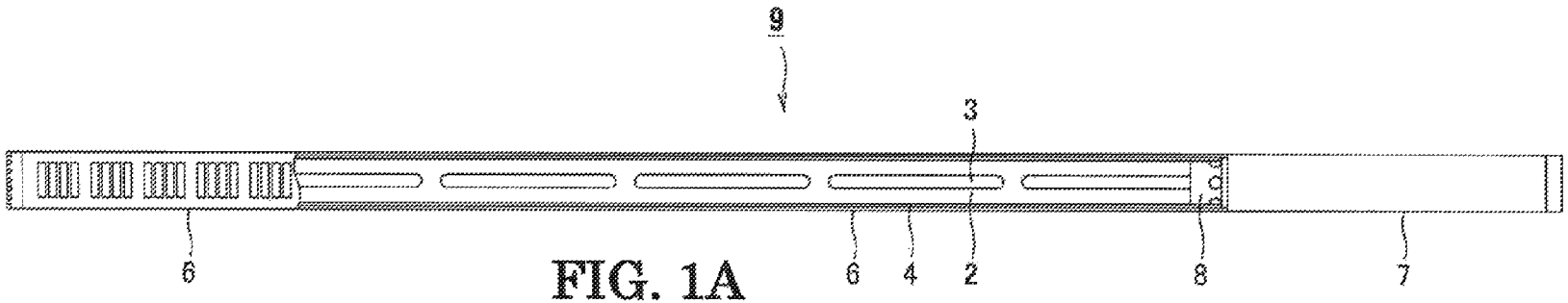
FIG. 1A is a partial cross-sectional front view of an embodiment of a narrow directional microphone according to the present invention before an air-shutoff sheet is attached.
Figure 1B:
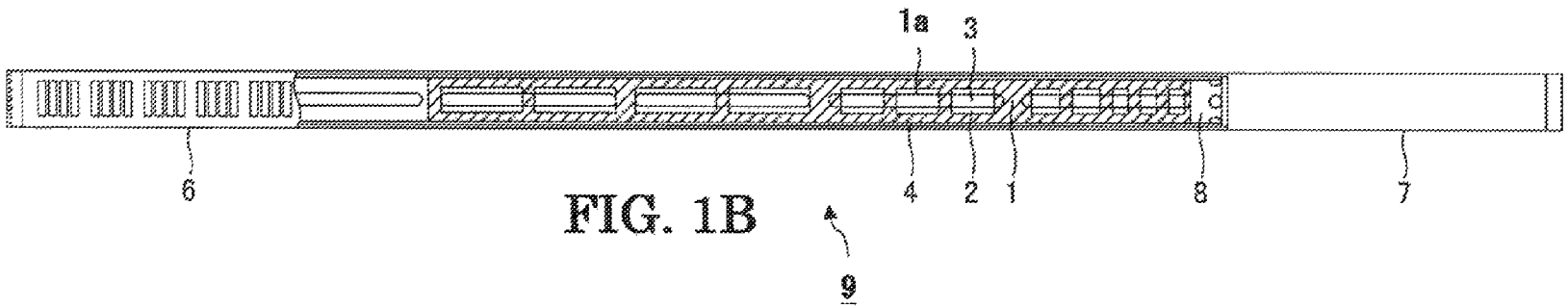
FIG. 1B is a partial cross-sectional front view of the embodiment shown in FIG. 1A after the air-shutoff sheet is attached.

An embodiment of a narrow directional microphone according to the present invention is described below with reference to some of the accompanying drawings. In FIG. 1A, a narrow directional microphone 9 includes: a microphone housing 6; an acoustic tube 2; a microphone unit 8; and a grip 7. As shown in FIG. 1B, the entire outer peripheral surface of the acoustic tube 2 is covered with an acoustic resistor 4.

The acoustic tube 2 is formed by curling a rectangular plate mainly made of metal such as aluminum or iron in a direction of the short side to be in a shape of an elongated cylinder. Both ends of the acoustic tube 2 are opened, and if the side of the grip 7 is the rear end and the side opposite therefrom is the front end in FIGS. 1A and 1B, the microphone unit 8 is provided to the inner periphery at the rear end portion of the acoustic tube 2. The microphone housing 6 having substantially cylindrical shape covers the outer periphery of the acoustic tube 2. Preferably, in terms of usefulness, the acoustic tube 2 is made of a light metal such as aluminum. A plurality slits 3 arranged in the axial direction is formed on the peripheral surface of the acoustic tube 2.

The slits 3 are formed on a plurality of portions on the acoustic tube 2 in the peripheral direction and are arranged in an axial direction with intervals therebetween. The acoustic resistor 4 covers the outer peripheral wall of the acoustic tube 2, and thus the slits 3 are also covered thereby. Portions at which the slit 3 is formed in the circumferential direction can be arbitrarily set according to the intended use. Only a single slit 3 can be formed. Still, to allow easy acoustic adjustment and provide certain strength to the acoustic tube 2, the slit 3 is preferably formed on two or three portions of the acoustic tube 2.

An air-shutoff sheet 1 overlaps the outer surface of the acoustic tube 4. The air-shutoff sheet 1 has, in the axial direction, a plurality of openings 1*a* of various lengths in the axial direction. The air-shutoff sheet 1 is attached in a manner that the openings 1*a* of the air-shutoff sheet 1 and the slits 3 of the acoustic tube 2 are overlapped with each other so that the sizes of the slits 3 are limited. The sizes of the openings 1*a* and how they overlap the slits 3 are arbitrarily set to obtain desired narrow directivity of the microphone 9. For example, if the slit 3 of the acoustic tube 2 has the length in the axial direction longer than that of the opening 1*a*, directivity is determined based only on the length of the opening 1*a*. This is preferable because the opening 1*a* can be designed efficiently and rationally. If the acoustic tube 2 has in the circumferential direction, a plurality of rows of openings 3, a plurality of air-shutoff sheets 1 is attached in the circumferential on the outer peripheral side of the acoustic tube 2 via the acoustic resistor 4.

The air-shutoff sheet 1 has a thin rectangular shape as a whole. Any materials that can shutoff air can be used as the air-shutoff sheet 1. The member maybe made of: organic compound resin such as polypropylene, polyethylene, and vinyl chloride; or inorganic materials such as aluminum and carbon. The air-shutoff sheet 1 made of elastic material is advantageous because with its deforming property, overlapping on the peripheral wall of the acoustic tube 2 is facilitated. Considering the cost, poly-ethylene-terephthalate (PET) is preferably used. The air-shutoff sheet 1 may have any thickness as long as the acoustic resistance of the acoustic tube 2 can be adjusted by shutting off the air. In this embodiment, a PET resin of a thickness of about 2.5 micrometers is used as the air-shutoff sheet 1. Instead, the thickness of the PET resin may be 0.5 micrometer, for example. As described above, the air-shutoff sheet 1 is attached to correspond to the slits 3 on the acoustic tube 2. An acoustic wave is guided into the acoustic tube 2 from a direction of a side wall surface of the microphone 9 through the openings 1*a*. The acoustic wave entering the acoustic tube from the direction of the side wall has a phase largely varied, and can be made to interfere with an acoustic wave of which the source is at the direction other than the front but entering the acoustic tube from the front end. Thus, acoustic waves other than that from a sound source in the front of the acoustic tube 2 are largely attenuated, thereby attaining extremely narrow directivity.

In the embodiment shown in FIG. 1B, the length of the opening 1*a* of the air-shutoff sheet 1 in the axial direction of the acoustic tube 2 becomes shorter, in other words, smaller in a step wise manner as the opening 1*a* gets closer to the sound pickup side microphone. In such a structure, the acoustic resistance of the acoustic tube 2 becomes larger as it gets closer to the sound pickup side microphone, and narrow directivity can be obtained in which frequency characteristic is flat and excellent. The openings 1*a* can have any shape as long as narrow directivity can be adjusted. For example, the shape can be rectangular as shown in, FIGS. 1B and 3B or circular as that of openings 1*b* shown in FIG. 4, which becomes smaller in size as the openings 1*b* get closer to sound pickup side microphone.

As described above, the narrow directional microphone according to the present invention uses the air-shutoff sheet 1, and by changing the air-shutoff sheet 1 to that having different openings 1*a*, the narrow directivity can be adjusted. Thus, processing of the slits 3 of the acoustic tube 2 mainly made of metal is not required upon adjusting the narrow directivity, so that the number of processes is reduced and yield rate is improved. As a result, manufacturing cost can be lowered, while the desired narrow directivity can be obtained.

Figure 2:
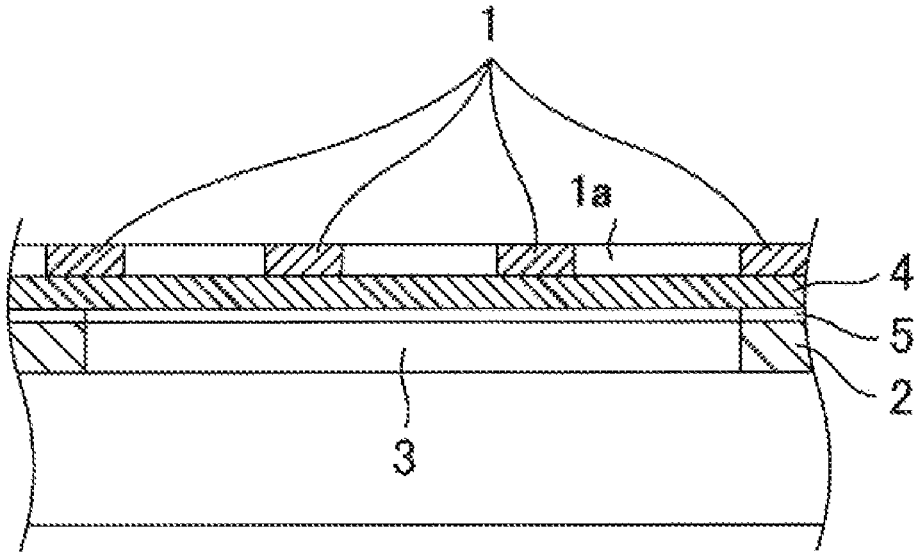
FIG. 2 is a partially, enlarged longitudinal cross-sectional view of the embodiment.
Figure 3A:
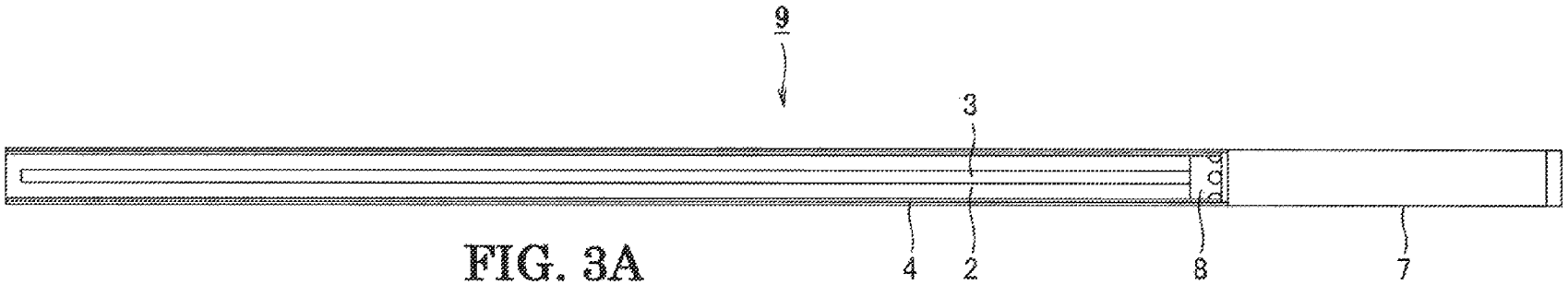
FIG. 3A is a partial cross-sectional front view of another embodiment of a narrow directional microphone according to the present invention before an air-shutoff sheet is attached.
Figure 3B:
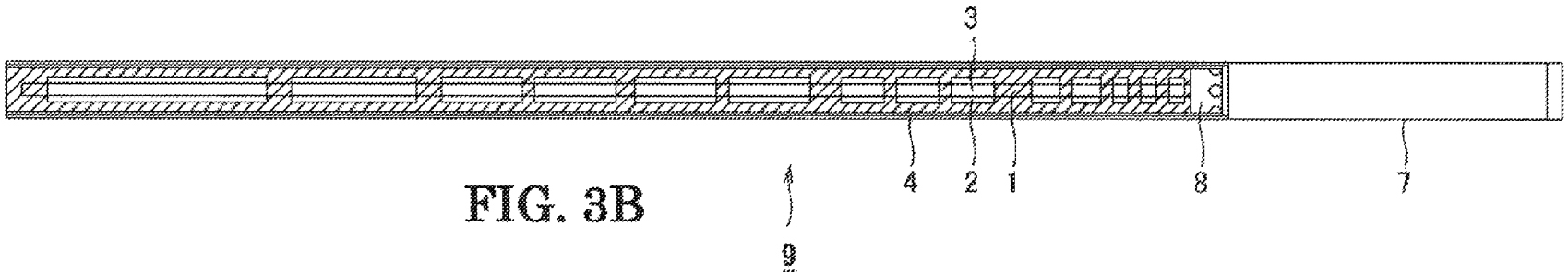
FIG. 3B is a partial cross-sectional front view of the embodiment shown in FIG. 3A after the air-shutoff sheet is attached.

FIG. 2 is an enlarged view depicting a positional relationship between the acoustic tube 2, the acoustic resistor 4, and the air-shutoff sheet 1. As described above, the outer peripheral surface of the acoustic tube 2 is covered with the acoustic resistor 4. The acoustic resistor 4 is adhered to the acoustic tube 2 with an adhesive 5 as shown in the figure. A plurality of openings 1*a* of the air-shutoff sheet 1 overlaps the single slit 3 of the acoustic tube 2. In FIG. 3B, the acoustic tube 2 has a single elongated rectangular slit 3 arranged in the axial direction thereof.

As shown in FIG. 3B, even if the single slit 3 is arranged on the acoustic tube 2 in the axial direction, by providing the air-shutoff sheet 1 thereon, the narrow directional microphone 9 can be adjusted only by changing the air-shutoff sheet 1 to that having different opening 1*a*. In other words, the acoustic tube 2 can have any number of slits 3 in the axial direction as long as the narrow directional microphone 9 can be adjusted with the openings 1*a* of the air-shutoff sheet 1.

In FIG. 1A and FIG. 1B, the outer periphery of the acoustic tube 2 is covered with the substantially cylindrical microphone housing 6, which serves as a protector for the acoustic tube 2. The microphone housing 6 may be made of metal, organic substance, carbon, and any other appropriate materials. The acoustic tube 2 having a cylindrical shape is inserted to the microphone housing 6. The microphone housing 6 has a plurality of elongated windows arranged in the direction orthogonal to the axis, that is, the circumference direction of the microphone housing 6. In the narrow directional microphone 9 according to the present invention, the acoustic tube 2 and the air-shutoff sheet 1 attached onto the acoustic resistor 4 play the main role for achieving its goal. The microphone housing 6 only plays the limited roll of protecting or reinforcing the acoustic tube 2. Accordingly, the windows of the microphone housing 6 provided at the outer periphery side of the acoustic tube 2 are not required to serve as the acoustic resistor and thereby preferred to be large as possible as long as the microphone housing 6 can sufficiently serve as a protector.

The microphone unit 8 is held by the microphone housing 6 at its outer periphery via the acoustic tube 2. A clearance may be made between the outer periphery of the microphone unit 8 and the inner periphery of the acoustic tube 2 so that a front and a rear acoustic terminals of the microphone unit 8 is acoustically short circuited by acoustic impedance offered by the clearance. Noise caused by winds can thus be reduced.

The cylindrical grip 7 is integrally and continuously connected to the microphone housing 6 at the rear end of the microphone housing 6. The rear end of the grip 7 may be arbitrary formed according to the intended use. For example, a connector not shown in the figure may be provided thereat for transmitting outward an acoustic signal, which has been subjected to conversion into an electrical signal by the microphone unit 8. An appropriate wireless communication unit may be provided thereat to obtain a wireless microphone. Moreover, a circuit board may be provided that connects between the connector and the microphone unit 8 and performs an electrical process as required.

Figure 4:
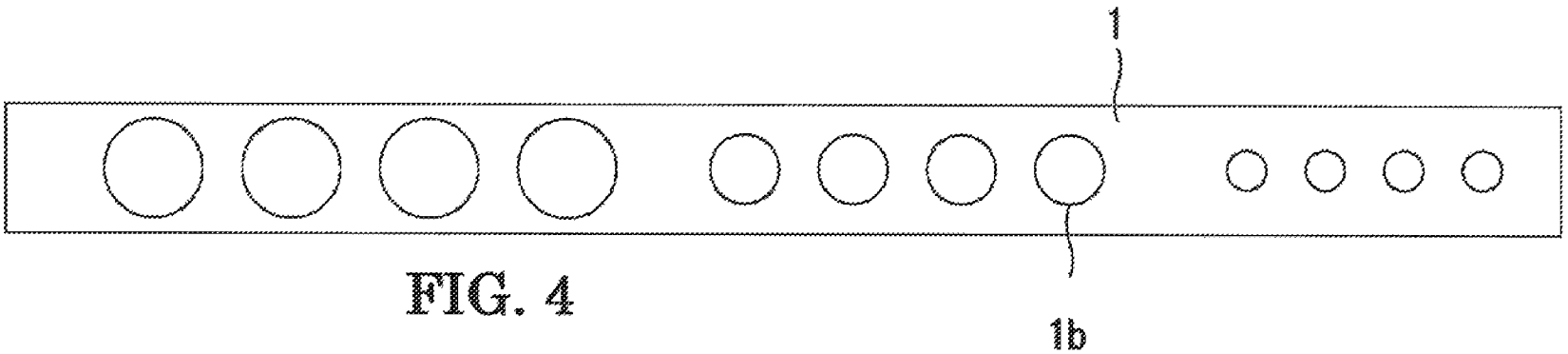
FIG. 4 is a front view of another embodiment of an air-shutoff sheet that can be applied to the narrow directional microphone according to the present invention.

FIG. 4 shows another example of an air-shutoff sheet that can be used in the present invention. This air-shutoff sheet 1 is different from that of the aforementioned embodiment in that the shape of the openings 1*b*, which overlaps the slit 3 of the acoustic tube 2 to restrict the slit 3, is circular. The diameter of the opening 1*b* decreases in a step wise manner from one end to the other end in the longitudinal direction of the air-shutoff sheet 1. The air-shutoff sheet 1 is fixed to the outer peripheral surface of the acoustic tube 2 directly or via an acoustic resistor 4 with the openings 1*b* thereof overlapping the slit 3 and in a manner that the diameter of the openings 1*b* becomes smaller froth the front end to the rear end of the acoustic tube 2.

Figure 5:
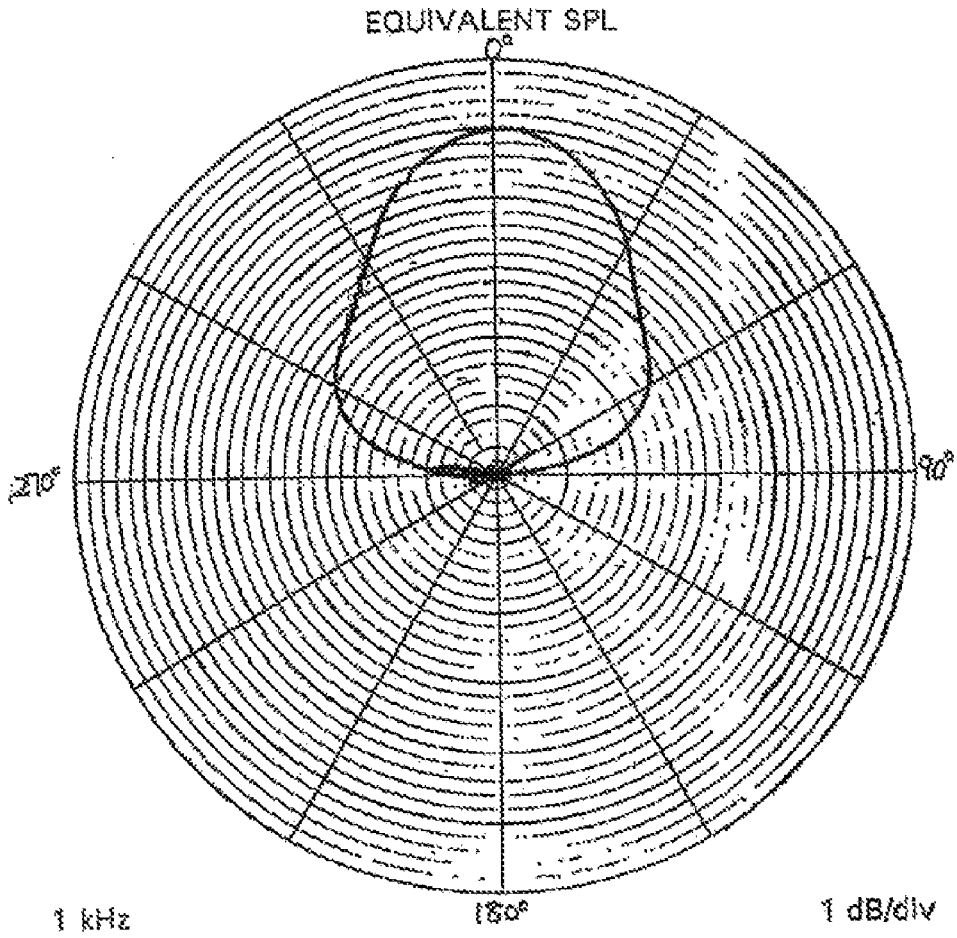
FIG. 5 is a graph depicting directivity of a microphone with no air-shutoff sheet attached.
Figure 6:
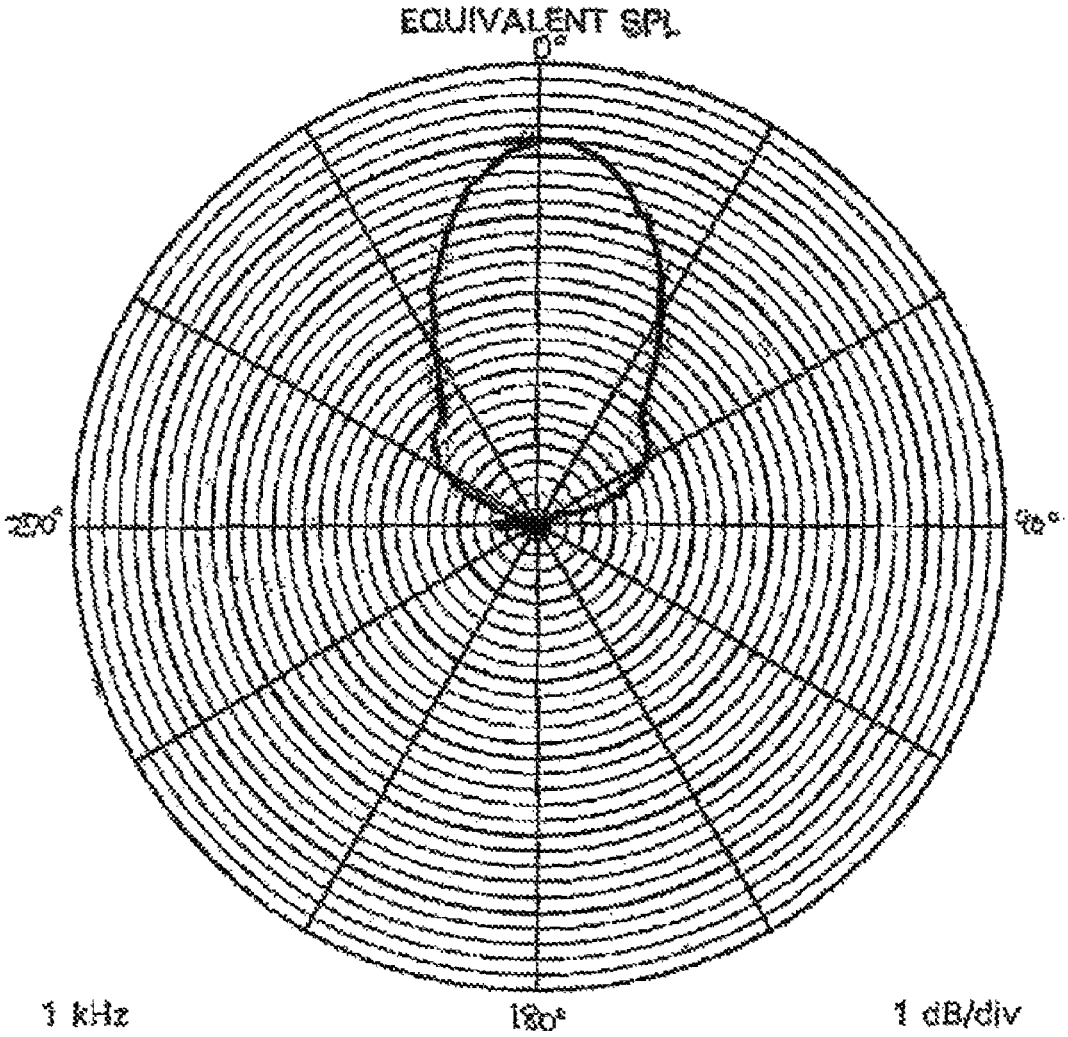
FIG. 6 is a graph depicting directivity of a microphone with an air-shutoff sheet having rectangular openings attached.
Figure 7:
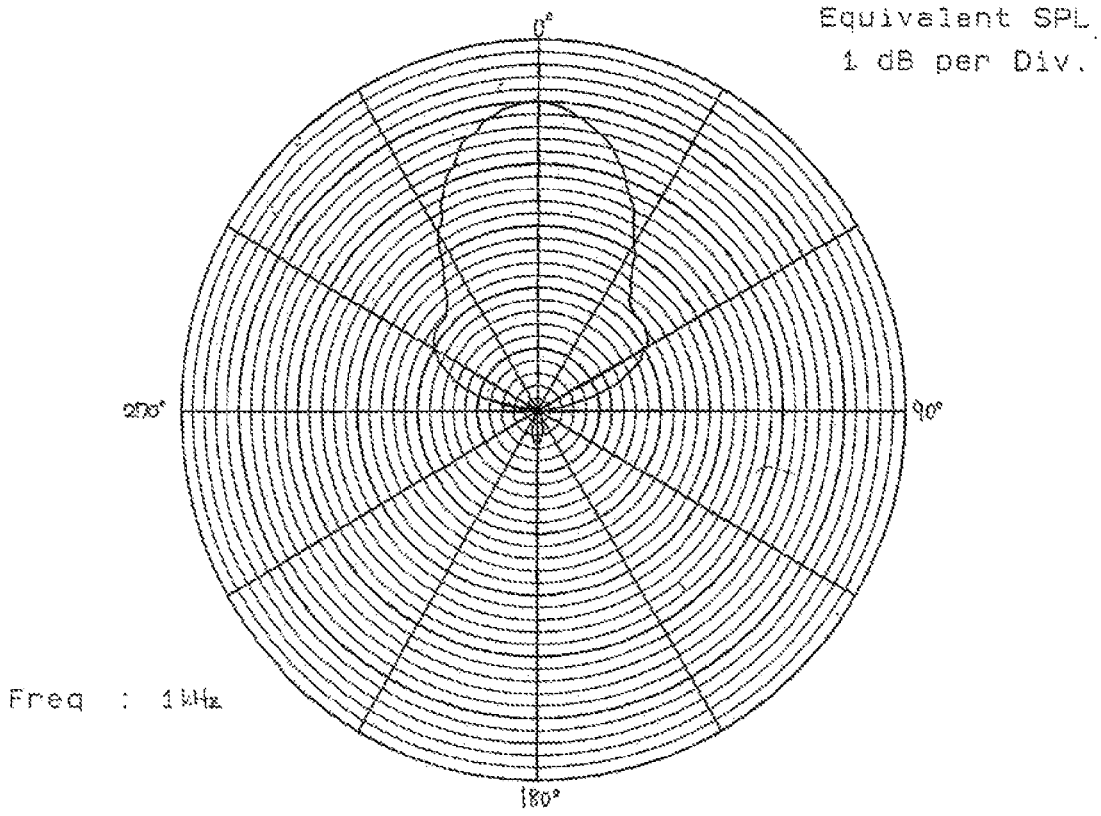
FIG. 7 is a graph depicting directivity of a microphone with an air-shutoff sheet such as that shown in FIG. 4 attached on an acoustic tube.
Figure 8:
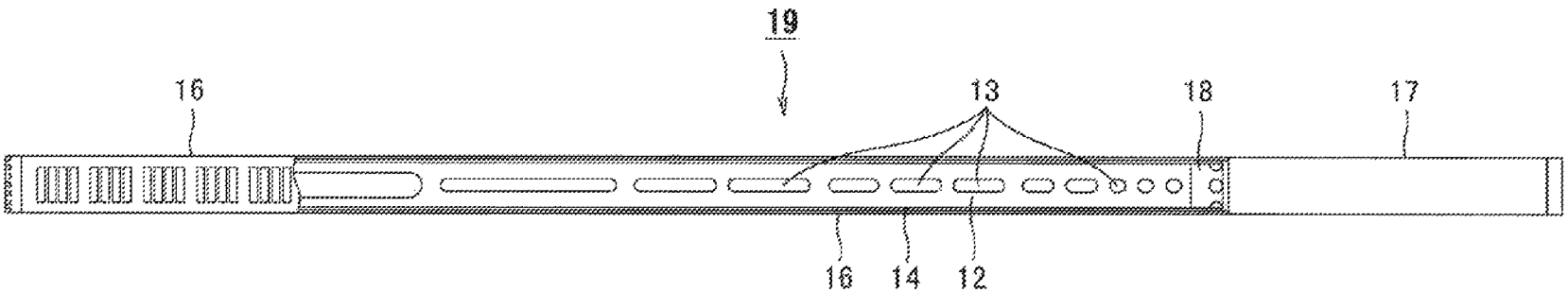
FIG. 8 is a cross-sectional view of a conventional narrow directional microphone.
Figure 9:
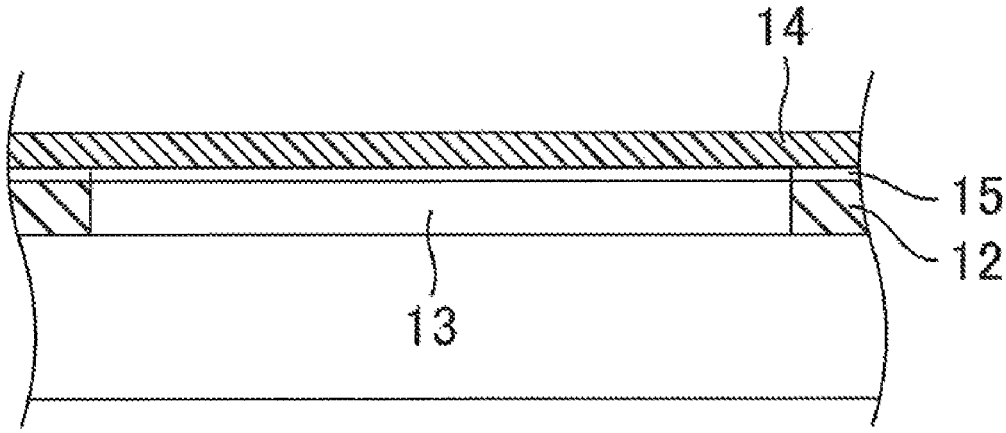
FIG. 9 is a partially enlarged longitudinal cross-sectional of the conventional narrow directional microphone.

FIGS. 6 and 7 are graphs depicting the directivity of the narrow directional microphone according to the present invention. A graph of FIG. 5 depicts the directivity of a microphone with the acoustic tube 2 not covered with the air-shutoff sheet 1 to be compared with directionalities of the narrow directional microphone according to the present invention. The graph in FIG. 6 depicts the directivity of a microphone having: as in the embodiment described in FIG. 1, rectangular opening 1*a*; and a PET film having the thickness of 2.5 micrometers as the air-shutoff sheet 1 attached on the outer surface of the acoustic resistor 4 of the acoustic tube 2. FIG. 7 depicts the directivity of a microphone having the structure same as that in FIG. 6, except that the PET film having the thickness of 2.5 micrometers has the circular openings 1*b* as shown in FIG. 4. The graphs of FIGS. 5, 6, and 7 are obtained as a result of measurements all of which using the acoustic tube 2 having the same structure.

The graphs depict results of measurement in which: the longitudinal front end of the narrow directional microphone is directed toward a sound emitting device to define the position of the 0 degree direction; and from that position, the front end is rotated away while measuring acoustic waves. Thus, narrow directivity of each of the microphones can be visualized.

In FIG. 5 an area enclosed by a heavy line extends further in 90 and 270 degrees directions compared with that in FIG. 6, meaning that the microphone of FIG. 5 collects more sounds other than that from the front. In the graph of FIG. 6 depicting the directivity of the microphone with the PET film having the rectangular openings 1*a* attached, the area surrounded by the heavy line is clearly thinner in 0 degree axis direction than in FIG. 5, thus proving the narrow directivity.

Similarly, in the graph of FIG. 7 depicting the directivity of the microphone with the film having the circular openings 1*b*, the area surrounded by the heavy line is clearly thinner in 0 degree axis direction than in FIG. 5, thus proving the narrow directivity. All things considered, narrow directional microphones having a PET film serving as the air-shutoff sheet in the present invention on an acoustic tube assures narrow directivity.

The specific structure of the narrow directional microphone according to the present invention is not limited to those in the embodiments described with reference to some of the drawings. The main effect of the present invention is making the adjustment of the narrow directivity possible only through changing an air-shutoff sheet to that having an opening of different shapes. Thus, the openings of the air-shutoff sheet may not necessarily become smaller as the openings get closer to the position at which the microphone unit 8 is provided. If more than one opening is formed in the circumferential direction of an acoustic tube, the shapes of the openings of the air-shutoff sheet can be a combination of appropriate shapes, e.g., a combination of rectangular openings and circular openings. Positional relationship between an acoustic resistor, an air-shutoff sheet, and an acoustic tube can be arbitrary set: an air-shutoff sheet may be provided inside an acoustic tube; or an acoustic resistor and an air-shutoff sheet may both be provided inside an acoustic tube. In the latter case, order in which the acoustic resistor and the air-shutoff sheet are overlapped can be arbitrarily set. Alternatively, an acoustic resistor may cover the outer periphery of an outer wall of an acoustic tube and an upper surface of an air-shutoff sheet, which is attached on the outer wall of the acoustic tube with openings of the both overlapped as described above.

The narrow directional microphone according to the present invention can be used as professional acoustic equipment or as an accessory microphone attached to, for example, acoustic equipment and a video recorder.

What is claimed is:

1. A narrow directional microphone comprising:

a microphone unit;

an acoustic tube having an opening on a peripheral wall along an axial direction and incorporating the microphone unit;

an acoustic resistor that covers the opening of the acoustic tube; and an air-shutoff sheet which is made from a material which will shutoff air, wherein said air-shutoff sheet overlaps the acoustic tube, wherein said air-shutoff sheet has a plurality of openings which have various lengths in the axial direction of the acoustic tube, wherein the openings of the air-shutoff sheet overlap the opening of the acoustic tube so that a size of the opening of the acoustic tube is effectively limited.

2. The narrow directional microphone according to claim 1, wherein the air-shutoff sheet detachably attached on the acoustic tube.

3. The narrow directional microphone according to claim 1, wherein the length of the openings of the air-shutoff sheet in the axial direction of the acoustic tube becomes shorter from an opening end of the acoustic tube to a portion at which the microphone unit is provided.

4. The narrow directional microphone according to claim 2, wherein the length of the openings of the air-shutoff sheet in the axial direction of the acoustic tube becomes shorter from an opening end of the acoustic tube to a portion at which the microphone unit is provided.

5. The narrow directional microphone according to claim 1, wherein a shape of the openings of the air-shutoff sheet is rectangular.

6. The narrow directional microphone according to claim 1, wherein a shape of the openings of the air-shutoff sheet is circular.

7. The narrow directional microphone according to claim 1, wherein the air-shutoff sheet is a resin film.

8. The narrow directional microphone according to claim 7, wherein the resin film is poly-ethylene-terephthalate.

9. The narrow directional microphone according to claim 2, wherein the air-shutoff sheet is a resin film.

10. The narrow directional microphone according to claim 9, wherein the resin film is poly-ethylene-terephthalate.

11. The narrow directional microphone according to claim 3, wherein the air-shutoff sheet is a resin film.

12. The narrow directional microphone according to claim 11, wherein the resin film is poly-ethylene-terephthalate.

13. The narrow directional microphone according to claim 4, wherein the air-shutoff sheet is a resin film.

14. The narrow directional microphone according to claim 13, wherein the resin film is poly-ethylene-terephthalate.

15. The narrow directional microphone according to claim 5, wherein the air-shutoff sheet is a resin film.

16. The narrow directional microphone according to claim 15, wherein the resin film is poly-ethylene-terephthalate.

17. The narrow directional microphone according to claim 6, wherein the air-shutoff sheet is a resin film.

18. The narrow directional microphone according to claim 17, wherein the resin film is poly-ethylene-terephthalate.

19. The narrow directional microphone according to claim 1, wherein the acoustic resistor covers an outer periphery of the acoustic tube, and the air-shutoff sheet overlaps an outer periphery of the acoustic resistor.

20. A narrow directional microphone comprising:

a microphone unit;

an acoustic tube having an opening on a peripheral wall along an axial direction and incorporating the microphone unit;

an acoustic resistor that covers the opening of the acoustic tube; and an air-shutoff sheet which overlaps the acoustic tube, said air-shutoff sheet having a plurality of openings which have various lengths in the axial direction of the acoustic tube, wherein the openings of the air-shutoff sheet overlap the opening of the acoustic tube so that an acoustic resistance of said acoustic tube is adjusted by shutting off air at portions of said opening of the acoustic tube.

* * * * *